United States Patent [19]

Raymond

[11] Patent Number: 4,836,821

[45] Date of Patent: Jun. 6, 1989

[54] TOY BIRTHING APPARATUS WITH CHUGGING-LIKE DELIVERY MOTION

[76] Inventor: Douglas Raymond, R.R.I Box 2390, Freedom, Me. 04941

[21] Appl. No.: 97,501

[22] Filed: Sep. 16, 1987

[51] Int. Cl.[4] ..... A63H 3/20; A63H 13/02

[52] U.S. Cl. ..... 446/330; 446/310; 446/475

[58] Field of Search ..... 446/141, 142, 199, 268, 446/295, 296, 308, 309, 310, 330, 369, 475; 434/267, 273

[56] References Cited

U.S. PATENT DOCUMENTS

| | | | |
|---|---|---|---|
| 949,544 | 2/1910 | Muehlstein | 446/310 |
| 968,057 | 8/1910 | Iwata | 446/310 |
| 1,089,229 | 3/1914 | Klein | 446/310 |
| 1,202,301 | 10/1916 | MacKaye | 446/310 |
| 2,776,525 | 1/1957 | Ford | 446/199 |
| 4,237,649 | 12/1980 | Goldfarb et al. | 446/330 |

FOREIGN PATENT DOCUMENTS

| | | | |
|---|---|---|---|
| 2448368 | 10/1980 | France . | |
| 2554360 | 5/1985 | France | 446/268 |
| 2177611 | 1/1987 | United Kingdom | 446/268 |

*Primary Examiner*—Robert A. Hafer
*Assistant Examiner*—Charles H. Harris
*Attorney, Agent, or Firm*—Ostroloenk, Faber, Gerb & Soffen

[57] ABSTRACT

Toy apparatus is provided with delivery structure constructed to simulate a natural birthing process by imparting slow pulsating delivery motion to fetal dolls as they exit from a simulated birth canal. Such delivery structure includes an elongated cylinder which constitutes a birth canal, a piston mounted for longitudinal movement within the cylinder, a spring that biases the cylinder forward to push fetal dolls in a delivery direction through the open front end of the cylinder, and retarding structure acting on the piston in opposition to the spring. The retarding structure includes a seal function alloy engaged with the cylinder and carried by the piston, and metering structure to create a vacuum behind the piston by limiting the rate at which air is drawn into the cylinder behind the piston while the latter moves forward.

21 Claims, 3 Drawing Sheets

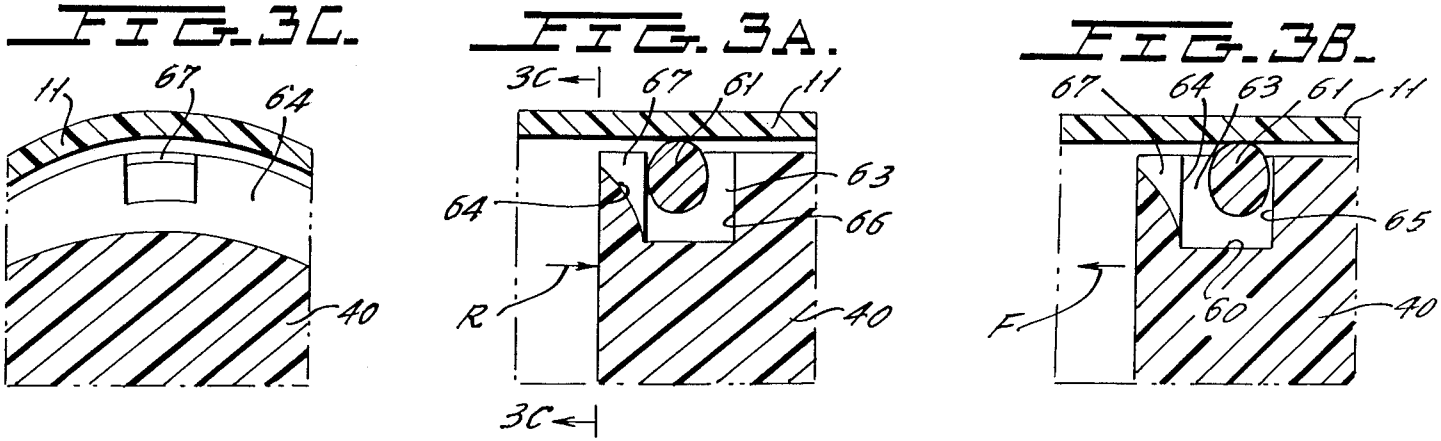
FIG. 3B.
FIG. 3A.
FIG. 3C.
11
61
63
64
65
66
67
40
60
F
R
3C
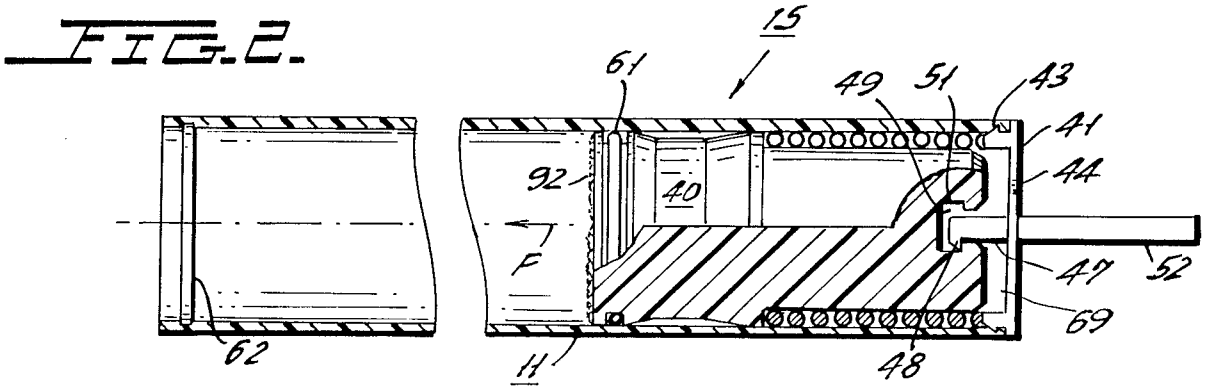
FIG. 2.
15
40
41
43
44
47
48
49
51
52
61
62
69
92
11
F

TOY BIRTHING APPARATUS WITH CHUGGING-LIKE DELIVERY MOTION

BACKGROUND OF THE INVENTION

This invention relates to playthings in general, and more particularly relates to a doll apparatus that is constructed to simulate motion of babies during the process of natural birth.

Many teaching aids and toys have been devised to simulate the birth of babies, both human and animal. In particular, [French patent publication No. 2 554 360 ] discloses a manually operated pusher to move a fetal doll shaped as a human along a birth canal and deliver same through an exit at one end of the canal. In [U.S. Pat. No. 4,237,649, ] issued Dec. 9, 1980 to A. E. Goldfarb and E. Dantzer for Toy Animal Figures Representing Parent Animal and Offspring, a continuous conveyor belt is used to simulate delivery of a fetal doll in the shape of a foal. The birthing simulations achieved through operation of the devices disclosed in the aforesaid French Pat. No. 2 554 360 and U.S. Pat. No. 4,237,649 do not approach actual delivery conditions in that consideration is not given to the characteristic motion for a baby during delivery thereof. That is, the motion of a baby during delivery is relatively slow and pulsates at a low rate. Such motion may be termed chugging along.

Simulation of this chugging or pulsating characteristic is addressed in the prior art by [U.S. Pat. No. 3,822,486 ] which issued July 9, 1974 to C. F. knapp and G. S. Zeades for A Dynamic Childbirth Simulator For Teaching Maternity Patient Care. According to such U.S. Pat. No. 3,822,468, the slow pulsating motion of delivery is simulated by precisely controlling delivery of pressurized air to a bladder system. Air pressure is varied by a relatively expensive electronic controller and the bladder is a relatively complicated structure, making the overall cost so high that use of those teachings found in U.S. Pat. No. 3,822,486 is restricted essentially to expensive apparatus used for giving instructions to nurses and doctors.

SUMMARY OF THE INVENTION

According to the instant invention, simulation of the slow pulsating motion characteristic of the birthing process is achieved in an economical and reliable manner. More particularly, in accordance with the instant invention, one or more fetal dolls are stored in an elongated cylinder in a chamber between the front open end of the cylinder and a piston that is mounted within the cylinder for longitudinal movement. A fluid seal is interposed between the piston and cylinder at the cylindrical interface therebetween, and a spring biases the piston forward or in the delivery (birthing) direction. As the piston moves forward in its working stroke, a metering orifice at the otherwise closed back end of the cylinder permits air to bleed slowly into an expandable chamber behind the piston. The metering orifice is so small that forward motion of the piston under the influence of the spring is retarded through the formation of a partial vacuum in the expandable chamber. The spring, the metering orifice and the frictional engagement between the seal and interior wall of the cylinder combine to create a condition such that movement of the piston in the birthing direction is at a relatively slow speed that pulses at a slow rate thereby simulating the characteristic motion of the delivery process.

Accordingly, the primary object of the instant invention is to provide a novel, inexpensive and reliable mechanism for simulation a birthing process.

Another object is to provide a mechanism of this type which achieves a relatively slow motion that pulsates at a slow rate.

Still another object is to provide a mechanism of this type that is purely mechanical.

A further object is to provide a mechanism of this type in which motion of a piston, closely fitted within a cylinder, is retarded through buildup of a partial vacuum in the cylinder as a result of limiting introduction of fluid into an expandable chamber of the cylinder located between the piston and the closed end of the cylinder.

Another object is to provide novel means to simulate multiple as well as individual births.

BRIEF DESCRIPTION OF THE DRAWINGS

These objects as well as other objects of this invention shall become readily apparent after reading the following description of the accompanying drawings in which:

FIG. 2 is a longitudinal cross-section of the delivery mechanism in FIG. 1.

FIGS. 3A and 3B are enlarged fragmentary cross-sectons through the "check valve" inlet in FIG. 2. In FIG. 3A, the piston is moving rearward to recharge the spring while in FIG. 3B the piston is moving forward in its working stroke.

FIG. 3C is a fragmentary cross-section through line 3C—3C of FIG. 3A looking in the direction of arrows 3C—3C.

DESCRIPTION OF THE PREFERRED EMBODIMENTS

Figure 1:
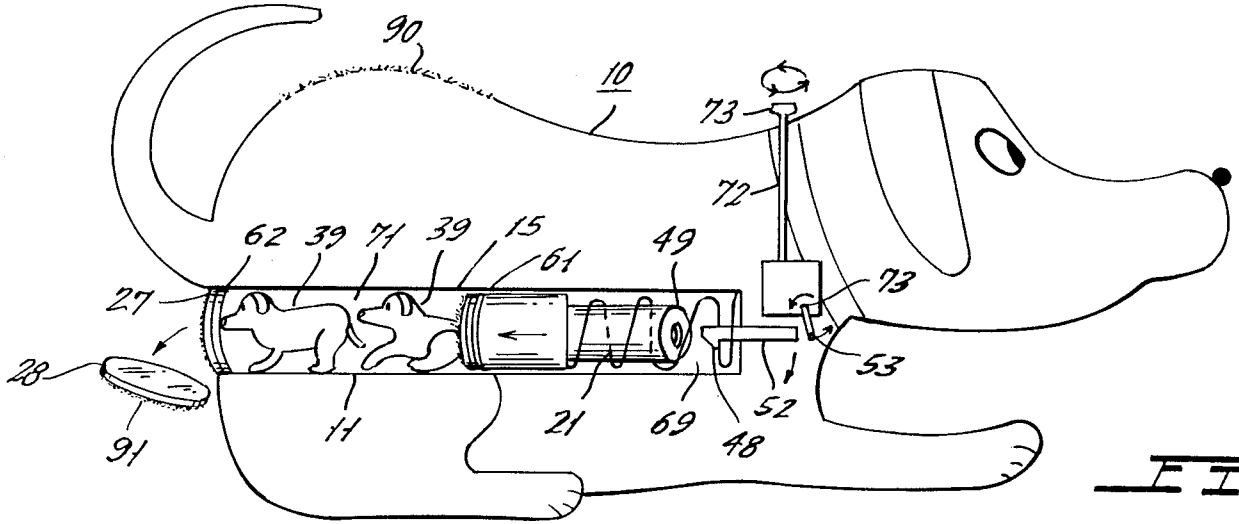
FIG. 1 is a diagrammatic view in side elevation of a mother animal that is provided with a delivery or birthing mechanism constructed in accordance with teachings of the instant invention.

Now referring to the figures and more particularly to FIGS. 1-3C wherein body 10 simulates the torso of an animal. Disposed therein is a delivery or birthing mechanism 15 including elongated plastic cylinder 11 which is open at its front end, shown at the left in FIG. 1. The rear or right end of cylinder 11 is closed by disk-like cap 41 having annular undercut protrusion 43 at the front thereof which is received with a snap fit by an annular groove in the interior surface of cylinder 11. To assure an airtight connection between cap 41 and cylinder 11, a sealant may be applied at the interface therebetween.

For a reason to be explained hereinafter, cap 41 is provided with metering orifice 44.

Extending from the center of cap 41 at the front thereof is projection 47 having latching formation or tip 48 at the free end thereof. The latter is received by chamber 49 at the rear of plastic piston 40 which is disposed for longitudinal movement within cylinder 11. Tip 48 is normally in engagement with interior shoulder 51 at the entrance to chamber 49. Extending axially from the center of cap 41 at the rear thereof is lever 52 that is engageable by dog or cam 53 as the latter is driven counterclockwise by motor 54. Dog 53 drives the free end of lever 52 downward with respect to FIG. 2 thereby flexing cap 41 so that latching tip 48 moves upward with respect to FIG. 2 to clear shoulder 51 and thereby release piston 40. With piston 40 not being held by latching tip 48, the force of spring 21 moves piston 40 forward in a working or delivery stroke that terminates when O-ring seal 61 falls into interior locking groove 62 of cylinder 11 at the front thereof. O-ring seal 61 is carried by piston 40, being mounted in annular groove 63 thereof.

As seen best in FIGS. 3A and 3B, groove 63 is oversized as compare with seal 61. That is, the cross-sectional diameter of seal 61 is substantially less than the distance between front and rear boundary walls 64, 65 of groove 63 and the internal diameter of seal 61 is substantially greater than the diameter of groove defining wall 66 that connects walls 64 and 65. When piston 40 moves in the forward direction indicated by arrow F in FIG. 3B, seal 61 provides a complete 360° seal between the interior surface of cylinder 11 and rear wall 65. Further, when piston 40 moves rearward, as indicated by arow R in FIG. 3A, it is in 360° engagement with the interior surface of cylinder 11 and is also in contact with front wall 64.

However, the latter is provided with at least one notch 67 of substantial size which now provides part of a pneumatic communication path between the front and rear of piston 40, such path also including the space between seal 61 and rear 65, the space between seal 61 and wall 66 and the space between the outside wall of piston 40 and the inside wall of cylinder 11. Thus, seal 61 acts as the movable member of a check valve which closes as pistion 40 moves forward F and opens when pistion 40 moves to the rear R. This permits piston 40 to be moved rapidly in the rearward direction R while forward movement F is retarded because air can bleed only slowly through small diameter metering orifice 44 of cap 41 into the expandable chamber 69 between cap 41 and the rear of piston 40. Coiled compression spring 21 disposed within chamber 69 biases piston 40 in the forward direction F. The portion of cylinder 11 in front of piston 40 constitutes a birth canal wherein a plurality of fetal dolls (pups) 39 are disposed when piston 40 is held in its reset position by latch 48. At this time, the front of cylinder 11 is closed temporarily by removable frictionally held plug 28 which also closes opening 27 in body 10.

The birthing process takes place by using knob 73, disposed outside of body 10 at the free end of rod 72, to wind and thereby charge spring motor 54. When the energy stored in motor 54 is released, say by pulling upward on rod 72, dog 53 on motor output shaft 74 rotates counterclockwise and in moving past extension 52 moves same to disengage latch tip 48 from piston 40 so that the latter may be moved forward by spring 21. Initial forward motion of piston 40 causes O-ring 61 to move to its sealing position against rear wall 65 of groove 63. Now the sole path for entry of air into expandable chamber 69 is through orifice 44.

The rate at which air bleeds into chamber 69 is so low that forward movement of piston 40 is greatly retarded by partial vacuum developed within chamber 69. Forward motion of piston 40 is also retarded by the friction force developed between the internal surface of cylinder 11 and seal 61 as the latter slides and/or rolls along the interior surface of cylinder 11. The net effect of these vacuum and friction forces acting in opposition to the force of spring 21 is to retard forward movement of piston 40 and results in a characteristic of speed versus position for piston 40 that is not smooth. Instead, this characteristic exhibits pulsations at a slow rate at least in part because the pressure level within expandable chamber 69 rises and falls but remains below ambient so that the vacuum force that opposes the biasing force provided by spring 21 pulsates. Further, the friction force at the interface between O-ring seal 61 and cylinder 11 varies for different positions of seal 61 along the length of cylinder 11. Thus, motion of piston 40 is step-like with a pause between steps, i.e. an intermittent, non-uniform advancement, in what may be termed chugging motion. That is, forward motion of piston 40 is relatively slow and pulstes at a slow rate, and during each pulse forward movement is relatively rapid. This forward motion of piston 40 pushes fetal dolls 39 to exit from torso 10 through opening 27 with a motion that simulates actual birthing motion.

The outside of torso 10 is covered with pile fabric 90 which is the same in color and other appearance characteristics as the covering 91 for the rear of plug 28. At the beginning of the birthing process, fetal dolls 39 moving through cylinder 11 engage plug 28 and force it to separate from cylinder 11. Now opening 27 is clear and remains so until the birthing process is complete, at which time opening 27 is closed by covering 92 on the rear of piston 40. Covering 92 is made of the same pile fabric that body skin 90 and covering 91 on plug 28 are made of.

Figure 4:
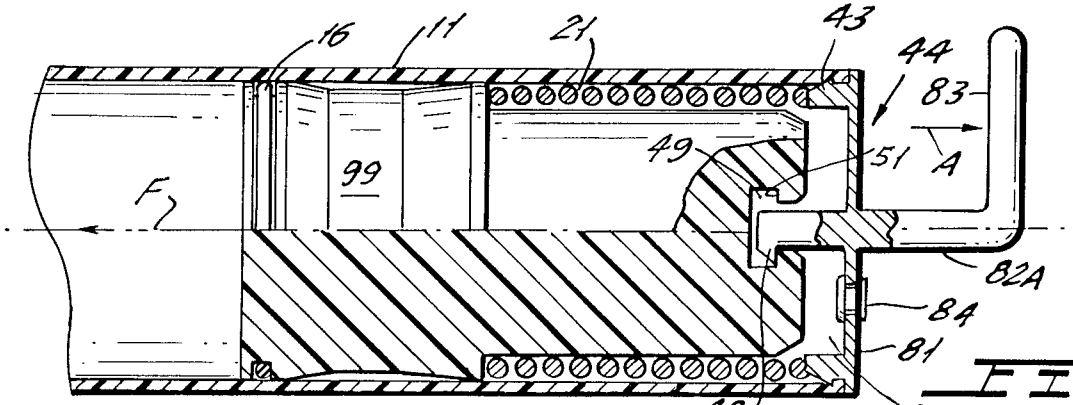
FIG. 4 is a fragmentary longitudinal cross-section of a delivery mechanism constructed in accordance with a second embodiment of this invention.

In the embodiment of FIG. 4, latching tip 48 is intended to be released manually by applying a force in the direction of arrow A to arm 83 of the L-shaped extension which projects from the rear of cap 81. The other arm of the L-shaped extension is connected to cap 81 at the center thereof and extends parallel to the axis of cylinder 11. Grommet-like member 84 mounted in a complementary opening of cap 81 constitutes the movable element of a check valve that permits air to leave expandable chamber 85 rapidly. As piston 99 moves forward, check valve element 84 closes so that entry of air into chamber 85 is limited by metering orifice 44.

Figure 5:
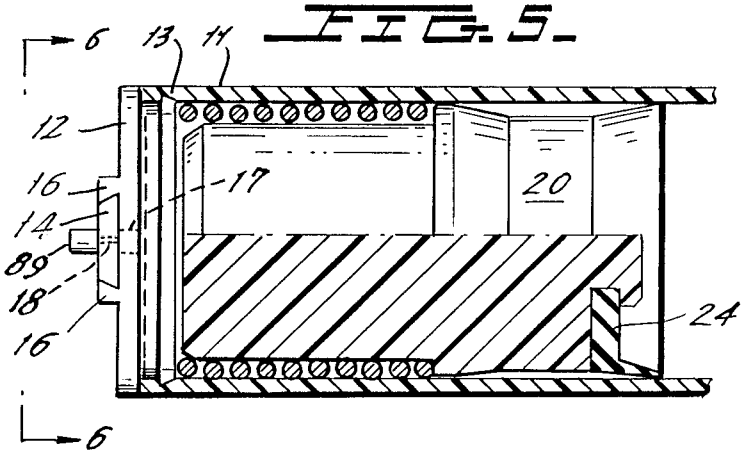
FIG. 5 is a fragmentary longitudinal cross-section of a delivery mechanism constructed in accordance with a third embodiment of this invention.
Figure 7:
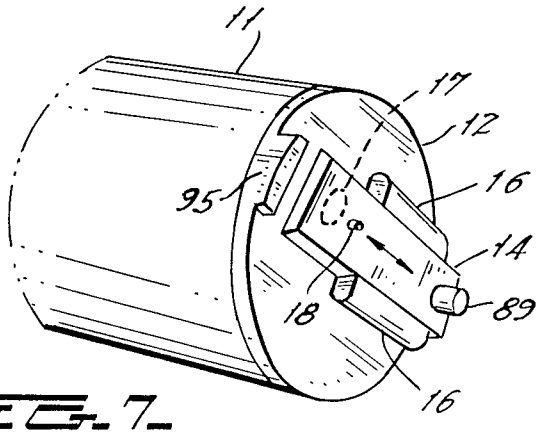
FIG. 7 is a fragmentary perspective looking at the closed end of the cylinder which forms the birth canal of the birthing mechanism of FIGS. 5 and 6.
Figure 6:
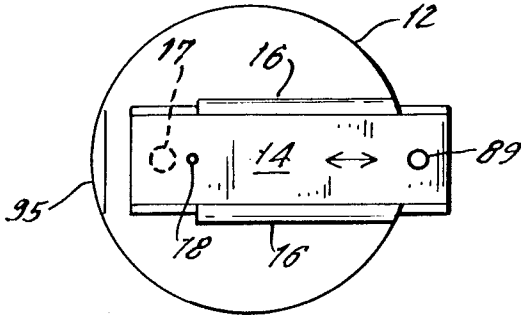
FIG. 6 is an elevation looking at the closed rear end of the cylinder in FIG. 5 looking in the direction of arrows 6—6.

In the embodiment of FIGS. 5–7, the rear of cylinder 11 is closed by disk-like cap 12 that is held in place by snap-fitted ring formation 13. Rubber slide 14 mounted to the outer surface of cap 12 is guided by essentially parallel undercut strips 16, 16 formed integrally with cap 12. Slide 14 normally covers relatively large aperture 17 in cap 12. Slide 14 is provided with very small diameter metering orifice 18 that is selectively positionable in alignment with aperture 17 to permit air to enter cylinder 11 at a very slow rate. Slide 14 functions as a check-valve in that slide 14 is flexible enough to permit air to be expelled readily from cylinder 11 through aperture 17 when piston 20 is moved toward cap 12, yet most of aperture 17 is sealed by slide 14 when air is being drawn into cylinder 11 through metering orifice 18. Coiled compression spring 21 is interposed between circular ridge 22 of piston 20 and the rear of cap 12 to bias piston 20 forward or toward the open end of cylinder 11. Annular flap-type seal 24 is mounted to piston 20 at the front thereof and is self-biased against the interior wall of cylinder 11.

With slide 14 in its normal inactive position shown in FIG. 6, the check valve action of flexible slide 14 seals aperture 17 so that forward movement of piston 20 under the influence of spring 21 will be resisted by creation of a reduced pressure or vacuum condition within expandable chamber 29 that is formed within cylinder 11 between closure cap 12 and the rear of piston 20.

To commence the birthing process, utilizing its projection 89, slide 14 is moved to the left with respect to FIG. 6 until engaging stop 95. Now metering orifice 18 is aligned with aperture 17 so that air may bleed into chamber 29 to raise the pressure therein, thereby reducing the vacuum force acting in opposition to the force of biasing spring 21. This permits piston 20 to move forward and force fetal dolls 39 within cylinder 11 through opening 27.

As in the embodiment of FIGS. 1-3C, even though air is permitted to bleed into expandable chamber 29, the rate at which this occurs is so low that forward movement of piston 20 is retarded greatly and the characteristic of speed versus position for piston 20 is not smooth. Instead, this characteristic exhibits pulsations at a slow rate because the pressure level within expandable chamber 29 rises and falls but remains below ambient so that the vacuum force that opposes the biasing force provided by spring 21 pulsates. The retarding force in piston 20 is enhanced by the frictional engagement of seal 24 with the interior of cylinder 11. The force of spring 21 opposed by the vacuum and friction forces acting on piston 20 moves the latter forward with a relatively slow motion that pulsates at a slow rate, and by so doing the motion of fetal dolls 39 as they exit through opening 27 simulates actual birthing motion.

Figure 8:
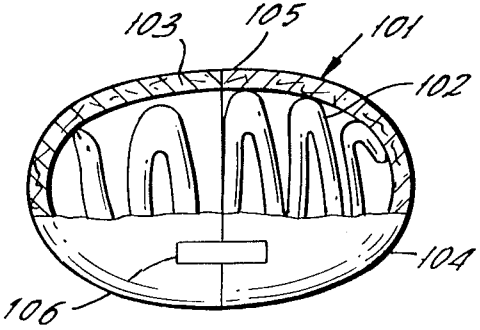
FIG. 8 is a partially sectioned elevation of a fetal doll within an egg.

While disposed within the simulated delivery canal, each fetal doll may be enclosed within an individual egg shell of the type shown in FIG. 8 wherein shell 101 encloses fetal doll 102 in the form of a snake. Shell 101 is formed of two sections 103, 104 that mate at interface 105 and may be constructed of water soluble material. After delivery, shell 101 is placed in water and will weaken to the point where the load spring (not shown) within doll 102 causes shell 101 to break so that doll 102 may be removed. As alternatives to constructing shell 101 of paper mache or other water soluble material, shell sections 103, 104 may be held together directly by a water soluble cement or by tape 106 that is water soluble and/or is coated with a water soluble cement.

It is noted that motor 54 (FIG. 1) may include a speed reducer so that shaft 74 rotates slowly to introduce a substantial delay from the time operation of motor 54 commences to the time piston 40 is unlatched to commence the birthing process. A time delay may also be introduced by electrical means, say by utilizing a solenoid (not shown), acting against a dashpot to operate arm 52 (FIG. 2), arm 83 (FIG. 4) and slide 14 (FIG. 6). Such solenoid may be operated remotely and may also operate an audio device (not shown). In the case of the birthing process for dogs, such audio device may emit a loud bark from the mother to signal that delivery is about to commence, and as the pups (fetal dolls 39) pass through opening 27, yelping sounds may be emitted. Further, elements 14, 52 and/or 83 may be operated to initiate the birthing process by moving (i.e. twisting, pulling) part of the mother, such as her ear, tongue, tail or nose, with movement of such part being mechanically coupled to such elements 14, 52 and/or 83.

After delivery, the apparatus may be reset by using a rod to push pistons 20, 40 and 99 to the rear. Such rod may be integrated with a nest that is adapted to store the mother doll. As an alternative, resetting may be accomplished by utilizing a filament (not shown) attached to piston 40 and extending outside of cylinder 11 through metering aperture 44. Such filament may be pulled directly. To gain a mechanical advantage, such filament may be wound with a crank mechanism (not shown) that is automatically disengaged when the piston is held by latch 48.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A toy birthing apparatus including:

a mother doll comprising first means defining a body having a delivery opening, and a birth canal defined by an elongated cylinder disposed within said body and extending rearward from said opening;

a piston disposed for longitudinal movement within said cylinder, biasing means urging said piston forward, second means for metering entry of air into an expandable chamber that is located within said cylinder behind said piston and in front of a transverse wall that closes said cylinder behind said piston, fluid seal means interposed between said piston and said cylinder, and said chamber expanding through forward movement of said piston;

third means defining at least one fetal doll disposed within said cylinder between said piston and said opening to be driven through the latter by forward movement of said piston under the influence of force exerted by said biasing means;

with said piston moving forward, said second means limiting entry of fluid into said chamber to a rate which when combined with force exerted by said biasing means on said piston causes pressure within said chamber to drop below ambient pressure whereby said fluid seal means causes said piston to move forward at a relatively slow speed in a an intermittent, non-uniform chugging-like motion at a low rate to drive said third means through said opening with movement which simulates that of natural delivery.

2. Toy apparatus as set forth in claim 1, also including fourth means providing a releasable mechanical latch that normally maintains the piston in a rear position in the vicinity of said transverse wall.

3. Toy apparatus as set forth in claim 2, also including means extending outside of said cylinder for releasing said latch.

4. Toy apparatus as set forth in claim 2, in which the second means includes an orifice of relatively small cross-section extending through said transverse wall.

5. Toy apparatus as set forth claim 4, in which the latch is secured to said transverse wall at the rear thereof; projection means extending from said transverse wall at the front thereof and positioned so that an unlatching force applied to said projection means deflects said rear wall and causes said latch to release said piston for forward movement of the latter by the biasing means.

6. Toy apparatus as set forth in claim 5, in which the biasing means includes a compression spring disposed within the expandable chamber.

7. Toy apparatus as set forth in claim 1, also including a check valve through which fluid is expelled from said expanable chamber when said piston is being reset by moving rearward in said cylinder.

8. Toy apparatus as set forth in claim 7, in which the check valve includes an aperture in said transverse wall and a slide normally closing said aperture; said second means including an orifice of relatively small cross-section extending through said slide; said slide being operable between a first and a second position; with said slide in said first position said orifice communication with said expandable chamber through said aperture and with said slide in said second position said orifice being remote from said aperture and being blocked from communicating with said expandable chamber.

9. Toy apparatus as set forth in claim 8, in which the transverse wall includes a front surface against which the slide slides in moving between the first and second positions.

10. Toy apparatus as set forth in claim 1, in which the piston is provided with a peripheral groove defined by spaced front and rear walls that are joined by connecting wall means, said fluid seal means comprising a resilient ring that surrounds said piston with a portion of said ring being disposed within said groove and another portion of said ring outside of said groove being frictionally engaged with said cylinder; with said piston moving forward, said ring being seated on said rear wall; with said piston moving rearward, said ring being seated on said front wall; said front wall having notch means that provides part of a passage means disposed inside cylinder and through which air may be expelled rapidly from said expandable chamber while the latter is being diminished in size by rearward movement of said piston.

11. Toy apparatus as set forth in claim 1, also including a plurality of simulated eggs each having an individual of said fetal dolls therein; each of said eggs being constructed of material that is water soluble.

12. Toy apparatus as set forth in claim 1, also including an openable cover for concealing the delivery opening when the third means is disposed within the birth canal; a simulated cover on said piston at the rear thereof; with said piston being moved to its rear position, having expelled the third means from the birth canal, said opening cover no longer concealing said opening and said simulated cover being disposed at said opening.

13. Toy apparatus as set forth in claim 12, in which the body on its exterior surface, the openable cover, and the simulated cover have similar appearances.

14. Toy apparatus as set forth in claim 13, in which the body on its exterior surface, the openable cover, and the simulated cover are coated with similar material having the same color.

15. Toy apparatus as set forth in claim 1, also including a plurality of simulated eggs each having an individual of said fetal dolls therein; each of said eggs being constructed of separable sections, and biasing means urging said sections apart to release said fetal doll from being enclosed therein.

16. Toy apparatus as set forth in claim 15, also including water soluble means that maintains said separable sections assembled to form a simulated egg.

17. Delivery apparatus including:

an elongated cylinder having an open front end;

a piston disposed for longitudinal movement within said cylinder;

biasing means urging said piston forward;

first means for releasably holding said piston in a rearward reset position;

second means disposed within said cylinder forward of said piston to be driven from said cylinder through said open front end by froward movement of said piston in a working stroke under the influence of said biasing means;

third means acting on said piston in opposition to said biasing means in a manner such that said piston moves forward with a an intermittent, non-uniform chugging-like motion, said third means comprising a fluid seal means carried by said piston and urged into engagement with the inner surface of the cylinder acting in cooperation with a fluid metering device to control entry of fluid into an expandable chamber in said cylinder behind said piston and partially bounded by the piston resulting in a partial vacuum in the chamber while the latter is expanding.

18. Delivery apparatus as set forth in claim 17, wherein said piston is provided with a peripheral groove defined by spaced front and rear walls that are joined by connecting wall means, and said fluid seal means comprises a resilient ring that surrounds said piston with a portion of said ring being disposed within said groove and another portion of said ring being frictionally engaged with piston; with piston moving forward, said ring being seated on said rear wall; with said piston moving rearward, said ring being seated on said front wall; said front wall having notch means that provides a passage means disposed inside of said cylinder and through which air may be expelled rapidly from said expandable chamber while the latter is being diminished in size by rearward movement of said piston.

19. Delivery apparatus as set forth in claim 17, also including stop means to limit forward movement of the piston to a position within said cylinder adjacent said front end.

20. Delivery apparatus as set forth in claim 19, in which the stop means includes a formation on said cylinder adjacent said front end to be engaged by and cooperate with said seal.

21. Delivery apparatus as set forth in claim 20, in which the biasing means is partially loaded when said formation and said seal are engaged to limit forward movement of the piston.

* * * * *